US008585496B2

(12) United States Patent
Demino et al.

(10) Patent No.: US 8,585,496 B2
(45) Date of Patent: Nov. 19, 2013

(54) PARI-MUTUEL WAGERING SYSTEM AND METHOD

(76) Inventors: Nicholas Demino, Rochester, NY (US); Timothy Neary, Rosemount, MN (US)

( * ) Notice: Subject to any disclaimer, the term of this patent is extended or adjusted under 35 U.S.C. 154(b) by 0 days.

(21) Appl. No.: 13/565,711

(22) Filed: Aug. 2, 2012

(65) Prior Publication Data

US 2012/0295698 A1 Nov. 22, 2012

Related U.S. Application Data

(60) Provisional application No. 61/514,629, filed on Aug. 3, 2011.

(51) Int. Cl.
*G07F 17/32* (2006.01)

(52) U.S. Cl.
USPC ..... 463/28; 463/16; 463/25

(58) Field of Classification Search
USPC ..... 463/27, 16, 25, 28
See application file for complete search history.

(56) References Cited

U.S. PATENT DOCUMENTS

| | | | | |
|---|---|---|---|---|
| 5,846,132 | A * | 12/1998 | Junkin | 463/42 |
| 7,094,151 | B2 | 8/2006 | Downes | |
| 2005/0003888 | A1 * | 1/2005 | Asher et al. | 463/25 |
| 2006/0252520 | A1 | 11/2006 | Plaits | |

FOREIGN PATENT DOCUMENTS

| | | |
|---|---|---|
| KR | 10-2000-0054392 | 9/2000 |
| KR | 10-2010-0001466 | 1/2010 |

OTHER PUBLICATIONS

PCT/US2012/049352—International Search Report and Written Opinion of the International Searching Authority, Feb. 25, 2013.

* cited by examiner

*Primary Examiner* — Omkar Deodhar
(74) *Attorney, Agent, or Firm* — Woods Oviatt Gilman LLP; Katherine H. McGuire, Esq.

(57) ABSTRACT

A method for conducting pari-mutuel wagering on an multi-action event, comprising the steps of providing at least one wagering computing system for ranking of participants in the event; establishing preliminary odds of winning a wager, based in part upon the rankings, for a plurality of individual actions of the multi-action event; accepting wagers for each of the plurality of individual actions; pooling respective wagers for each of the plurality of individual actions into a respective action-specific pool; calculating, using the wagering computing system, final odds of winning each of the plurality of individual actions using the action-specific pool; and paying winnings as determined by the final odds to one or more bettors who wagered a correct outcome for each of the plurality of individual actions.

14 Claims, 5 Drawing Sheets

300

| RANK (302) | PLAYER (304) | ODDS (306) |
|---|---|---|
| 1 | Michelson | 2 - 1 |
| 2 | Woods | 5 - 1 |
| 3 | McIlroy | 7 - 1 |
| 4 | Yang | 10 - 1 |
| 5 | Garcia | 12 - 1 |
| 6 | Els | 15 - 1 |
| 7 | Stewart | 18 - 1 |
| 8 | Verplank | 20 - 1 |
| 9 | Poulter | 25 - 1 |
| 10 | Kim | 30 - 1 |

FIG. 3

400

| RANK | PLAYER | ODDS |
|---|---|---|
| 2 | Woods | 2 - 1 |
| 1 | Michelson | 5 - 1 |
| 4 | Yang | 7 - 1 |
| 5 | Garcia | 10 - 1 |
| 3 | McIlroy | 12 - 1 |
| 6 | Els | 15 - 1 |
| 7 | Stewart | 18 - 1 |
| 8 | Verplank | 20 - 1 |
| 9 | Poulter | 25 - 1 |
| 10 | Kim | 30 - 1 |

FIG. 4

500

| RESULTS (505) | PAYOUTS (510) |
|---|---|
| #2 and #1 | $1 Exacta - $8 |
| #2 and #1 | $1 Quinella - $5 |
| #2, #1, and #5 | $1 Tricfecta - $78 |

FIG. 5

PARI-MUTUEL WAGERING SYSTEM AND METHOD

CROSS REFERENCE TO RELATED APPLICATIONS

This application claims the benefit of U.S. Provisional Application No. 61/514,629, filed Aug. 3, 2011, which is incorporated herein by reference in its entirety.

FIELD OF THE INVENTION

The present invention relates to a system and method for pari-mutuel wagering; in particular, to a pari-mutuel wagering system and method for wagering on multi-action events wherein a bettor can wager on any number of the plurality of actions performed during that event. More particularly, the present invention relates to sporting events such as automobile and motorcycle races, golf, and tennis where an event is comprised of multiple days of competition, and where bettors may wager on results for individual actions within a specific day, the overall results of a specific day, or the overall results of the entire event, as well as results from a series of events which take place during a season.

BACKGROUND OF THE INVENTION

Pari-mutuel wagering is a betting system in which all bets of a particular type are placed together in a pool. Payouts for winning wagers are calculated once all wagering has closed, with the pooled wagers for a specific type shared among all winning bettors. The science of determining the outcome of a race is called handicapping. Typically, the house, or bookkeeper, extracts administrative fees and taxes from the pool prior to paying out the winnings. Pari-mutuel betting differs from fixed-odds betting in that the final payout is not determined until the pool is closed—in fixed odds betting, the payout is agreed at the time the bet is sold. The pari-mutuel wagering system is traditionally used for gambling on horse racing and sporting events of relatively short duration in which participants finish in a ranked order. The pari-mutuel gambling system has been applied to other events, such as NASCAR races and golf. However, use of pari-mutuel wagering is still limited to selecting the final positions of the event participants, with bettors generally wagering on properly predicting the winner, second-place, and/or third-place finishers.

Additionally, unlike many forms of casino gambling where bettors place wagers against the house, in pari-mutuel betting the bettor wagers against other bettors and not the house. Pari-mutuel gambling is frequently state-regulated, and offered in many places where gambling is otherwise illegal. Pari-mutuel gambling is often also offered at "off track" facilities, where players may bet on the events without actually being present to observe them in person. It is possible for a skilled player to win money in the long run at this type of gambling, but overcoming the deficit produced by taxes, the facility's take, and the breakage is difficult to accomplish and few people are successful at it. Independent off-track bookmakers have a smaller take and thus offer better payoffs, but they are illegal in some countries. However, the introduction of internet gambling has generated "rebate shops," typically located outside of the United States. Because these off-shore betting shops operate with minimal overhead, they are able to reduce their take from 15-18% to as little as 1 or 2% by returning some percentage of every bet made to the bettor yet still make a profit. As a result, these rebate shops allow skilled bettors to make a steady income.

Traditional pari-mutuel wagering systems generally encompass wagering which attempts to predict the outcome of an event. For purposes of explanation, examples of such wagers will be discussed in reference to the most common use of pari-mutuel wagering—horseracing. There may be several different types of wagers with each type of wager having its own pool. Straight bets include predicting the order of finish for a single participant: Win—to succeed the bettor must pick the horse that wins the race; Place—the bettor must pick a horse that finishes either first or second; and Show—the bettor must pick a horse that finishes first, second or third.

Beyond the straight bets are more complex bets known generally as "exotic bets." Examples of exotic bets include: Exacta—the bettor must pick the two horses that finish first and second, in the exact order; Trifecta—the bettor must pick the three horses that finish first, second, and third, in the exact order; and Superfecta—the bettor must pick the four horses that finish first, second, third and fourth, in the exact order. Bettors are also allowed to "box" exotic wagers which allows the bettor to bet all permutations of the numbers in the box. For instance, an exacta box with 2 numbers, commonly called a quinella, is a bet on one of two permutations: A first and B second, or B first and A second. A trifecta box with 3 numbers has 6 possible permutations (of the horses in the 'box' 3 can finish first, 2 can finish second, and one can finish third, $3\times2\times1$). As there are more chances to win based upon these permutations, a 'box' bet generally costs that specific number of permutation times the betting base amount (i.e. in the box trifecta example, the bet would cost 6 times the base amount). Alternative, a bettor could wager the base amount and have any winnings divided by the number of permutations. Houses typically require a larger wager than the base wager, but not necessarily the entire permutation multiple, in order to place a 'box' wager.

Further exotic bets frequently used in horseracing include: Duet—the bettor must pick the 2 horses who will place first, second or third but can finish in any order; Double—the bettor must pick the winners of two successive races with most race tracks taking double wagers on the first two races on the program (the daily double) and on the last two (the late double); Triple—the bettor must pick the winners of three successive races; like doubles, many tracks offer 'running' or 'rolling' triples; Quadrella—the bettor must pick the winners of four nominated races at the same track; and a Sweep—the bettor must pick the winners of four or more successive races. This is usually referred to as the pick four and pick six, with the latter paying out a consolation return to bettors correctly selecting five winners out of six races, and with "rollover" jackpots accumulating each day until one or more bettors correctly picks all six winners.

Beyond straight bets and exotic bets predicting win, place and show, an additional wager can be made on what is typically called an over-under. In an over-under wager, the sports book or line maker will predict a number for a particular statistic in a given event or a specific action within that event. The bettor will then wager whether the result will be above or below that number. By way of example, over-under wagers are typically made with regard to NFL football games with the statistic being the total number of points scored in the game. Thus, a line maker will establish the number using past performance and expert predictions. The line maker attempts to establish a number wherein half of the bets are on both sides of the over-under. While typically used for total points scored, the over-under wager can be extended to any scenario which will generate wagering action. For instance, with regard to golf an over-under wager could be made on the final positional standings a particular golfer, the number of putts made by a golfer, the number of birdies, bogies or pars made by a particular golfer, the total number of golfers above or below par during the first round, second round, third round or entire tournament. Indeed, over-under wagers can be extended to even non-sports scenarios such as the number of times the President will say "America" during the State of the Union Address.

As can be seen by the above description, pari-mutuel wagering is generally utilized with events that are short in duration with wagers selecting winners or top finishers in the events. Attempts have been made to extend pari-mutuel wagering to events outside of horseracing, such as golf, but these attempts often suffer from bettor indifference as these events, particularly golf, are multi-day events with a winner decided days after a wager is made. Thus, wagering on a winner before the event requires a bettor to wait three or four days before learning whether the wager will pay off or not. These futures bets fail to provide the excitement generated by immediate action, and current systems do not provide for more immediate wagering action, such as daily wagering during a four-day golf tournament or daily wagering on events during an auto racing event, such as qualifying/pole position; "happy hour" racing, as well as the final race event.

As such, there is a need for a system and method that enables and encourages pari-mutuel wagering for events beyond the traditional horseracing. Additionally, there is a need for a system and method that provides for pari-mutuel wagering throughout the course of an event, and not merely wagering on the winner or a specific series of finishers at the conclusion of the event. The present invention addresses these and other needs.

BRIEF SUMMARY OF THE INVENTION

In general, one embodiment the present invention is directed to a pari-mutuel wagering system for use with multi-activity events such as golf and automobile racing whereby bettors may wager on pre-established odds associated with each participant in the event. The system, as promoted by sports books in legalized jurisdictions such as Nevada and Europe, utilizes pre-event odds established by line makers having knowledge and experience related to such events. The pre-event odds are then influenced and modified in substantially real-time response to the placement of wagers on specific actions performed by event participants. That is, odds go down responsive to a high percentage of wager monies being placed on a specific action and/or a specific participant while odds go up as a low percentage of wagers are placed on other actions and/or participants. Sports books earn revenue by collecting a percentage of all wager pools funded by all placed wagers.

The embodiments of the present invention are well-suited for both brick-and-mortar sports books, as well as online sports books and internet gaming sites. Wagers made within brick-and-mortar sports books can either be conducted at bettor-reserved terminals or by placing a wager with an authorized sports book employee. Online sports books and gaming sites may be accessed using any suitable electronic device including, but not limited to, a desktop computer, a laptop computer, tablet computer, or a hand-held device such as a smart phone or personal data assistant (PDA).

Additional objects, advantages and novel features of the present invention will be set forth in part in the description which follows, and will in part become apparent to those in the practice of the invention, when considered with the attached figures.

BRIEF DESCRIPTION OF THE DRAWINGS

The accompanying drawings form a part of this specification and are to be read in conjunction therewith, wherein like reference numerals are employed to indicate like parts in the various views, and wherein:

FIG. 3 illustrates an exemplary list of pre-event opening odds for a golf event according to one embodiment of the present invention;

FIG. 4 illustrates an exemplary list of pre-event updated odds as modified responsive to wagers placed prior to the event according to one embodiment of the present invention;

FIG. 5 illustrates an exemplary list of golf wagers and potential payouts based on current odds according to one embodiment of the present invention;

DETAILED DESCRIPTION OF THE INVENTION

Figure 1:
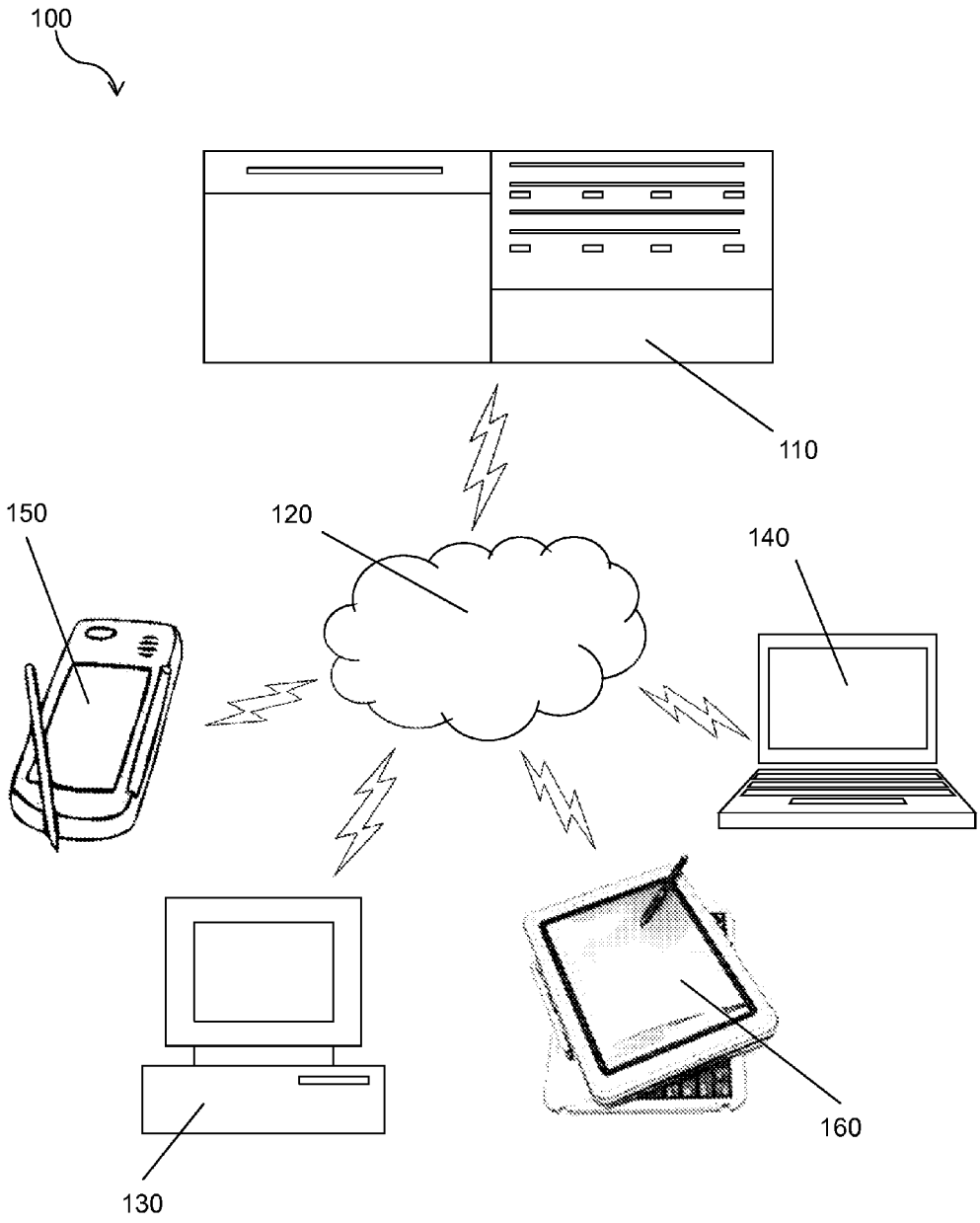
FIG. 1 is a block diagram showing a wagering system of one embodiment of the present invention.

Referring to the drawings in detail, and specifically to FIG. 1, a block diagram shows wagering system 100 of one embodiment of the present invention comprising an internet accessible wagering server 110 in communication with the internet 120. The wagering server 110 is accessed via the internet by various components represented generally by personal computer (PC) 130, laptop computer 140, smart phone/PDA 150, and tablet PC 160. It is also envisioned that wagering server 110 can be accessed via dedicated terminals located within casinos, racetracks, golf pro shops or any other properly equipped facility. Wagering server 110 is accessed directly by individual bettors or through placing wagers with an employee authorized by the server operator to input wagers within the server. When inputting wagers, individual bettors can place wagers in an individual or one-time manner, or can create a user account which is username and password protected, and is stored on the wagering server.

Figure 2:
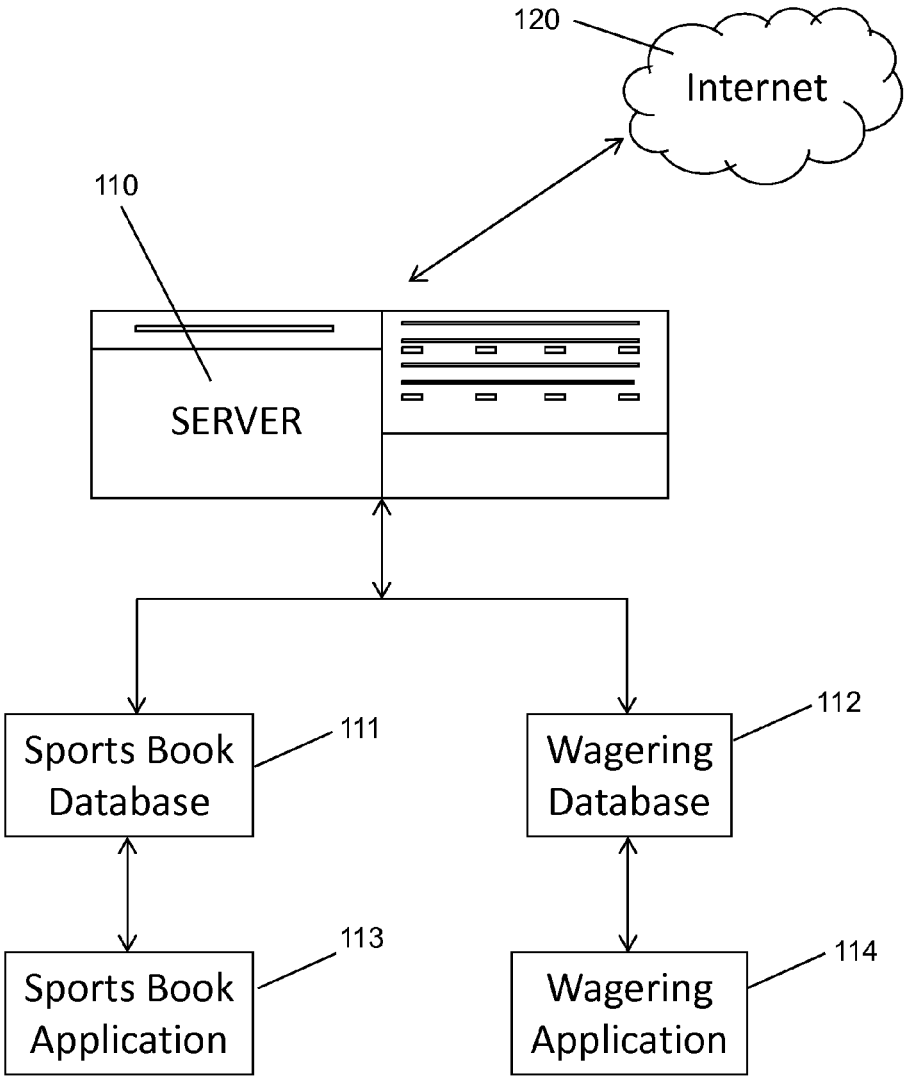
FIG. 2 is a block diagram showing wagering system architecture of one embodiment of the present invention.

Adverting now to FIG. 2, wagering server 110, accessible to internet 120, is generally comprised of a sports book database 111 and a wagering database 112. Sports book database 111 is populated with event-related information such as, but not limited to, specific events, event participants, individual event actions for which wagers will be accepted, and opening odds or updated odds for predicting participants satisfying those individual event actions, as will be discussed in more detail below. Information stored within the sports book database 111 is viewed and manipulated through a sports book application 113. The sports book application is user and password encrypted, and is accessible only by authorized sports book employees, such as authorized line makers (employees with knowledge and experience directed to the events, odds, and line establishment).

Also housed on wagering server 110 is wagering database 112. Wagering database 112 is accessed via wagering application 114. Bettors access the wagering application 114 through a direct terminal device, by use of an authorized sports book employee workstation, or through an internet connection as shown and described with reference to FIG. 1. Bettors can either log onto a user account to place wagers or simply place anonymous wagers. Logging onto a user account allows bettors to sort and track current wagers, as well as review wager history which may assist the bettor is placing future wagers. Once logged on, or when placing an anonymous wager, the wagering application 114 recalls bettor-selected information from the wagering database and displays the events on which wagers are being accepted, event participants on which the bettor may wager, individual event actions for which wagers will be accepted, opening odds or updated odds for participants satisfying those individual event actions, and the anticipated payout (at current odds) or actual payout calculated after wagers are no longer being accepted for a specific action. It is further envisioned that the wagering application allows bettors to view relevant betting information, such as weather conditions, participant performance history at the present event, participant performance over a bettor-selected period of time (i.e. one week, two weeks, one month before the present event), track/arena/venue information, or any other suitable information, which is stored within the wagering database 112.

The embodiments of the present invention are directed to pari-mutuel wagering options on multi-activity events, such as horse races, dog races, automobile races, bicycle races, golf, tennis, track-and-field events, Olympic events, motorcycle races and the like. The embodiments of the present invention are suitable for brick-and-mortar sports books, as well as online sports books and internet gambling websites.

Referring now to FIG. 3, an exemplary list 300 depicts a series of golfers 304, with their respective pre-event ranks 302 and opening odds 306 associated with that golfer satisfying a particular action, in this example winning the golf tournament. Pre-event rankings are based upon the Official World Golf Ranking. As shown, Mickelson is the favorite opening at 2 to 1, with Woods established at 5 to 1 and Garcia established at 12 to 1. Opening odds are established by line makers and stored on wagering server 110 within the sports book database 111 as described above with reference to FIG. 2. Based upon the opening odds, bettors are provided, via wagering application 114 housed on wagering database 112, with a series of pari-mutuel wager options including straight win wagers, second place finishers, third place finishers, exacta wagers, quinella wagers, trifecta wagers and superfecta wagers. The exacta, trifecta and superfecta wagers may also be boxed allowing the bettor to cover all conceivable finishing orders with 2, 3 or 4 golfers. The system also supports pari-mutuel wagers across separate, multiple successive individual actions with an event, as well as across events themselves. Thus, the pari-mutuel wagering system of the present invention allows a sports book to offer multi-action wager options whereby a bettor can, for example, place a wager on the golfer leading after each of the four rounds within a single golf tournament (i.e. Thursday's leader; Friday's leader; Saturday's leader; and tournament winner). The pari-mutuel wagering system of the present invention allows a sports book to further offer multi-event wager options such as wagering the predicted winner of a first golf tournament played during a first week (i.e. April 4-7) and the predicted winner of the next successive golf tournament (i.e. April 11-14).

Pari-mutuel wagering, unlike most casino games (e.g. blackjack, craps and roulette), aggregates all wagers into different pools from which payouts are made after various administrative deductions and taxes have been withdrawn. Thus, the more wagered on one or more participants, to continue the above example—golfers, the lower the odds and resultant payouts. Consequently, it is the bettors that are influencing the final odds and payouts. As wagers are placed, the software resident on the wagering server 110 (see FIGS. 1 and 2) modifies the odds in substantially real-time and displays the same on a sports book board, within the sports book application 113 and within the wagering application 114. Thus, bettors can view the updated odds at the brick-and-mortar facility, or on their internet-enabled devices as shown in FIG. 1. FIG. 4 shows an updated odds list 400 associated with the golf list 300 shown in FIG. 3. As shown in the updated list of FIG. 4, Woods is now the favorite at 3 to 1, with Mickelson now second favorite at 4 to 1. The odds may fluctuate until the event begins, at which time wagers will no longer be accepted and the final odds and payouts are calculated. As the straight odds change, the payouts associated with the pari-mutuel style wagers fluctuate as well based upon the corresponding wager pools.

FIG. 5 shows an exemplary portion of a list 500 of pari-mutuel golf wagers 505 and payouts 510 based on current odds as shown in FIG. 4. The list 500 shows payouts associated with winning exacta, quinella and trifecta wagers for two and three selected golfers. In a practical setting, a sports book board or an internet-enabled device accessing the wagering database 112 via wagering application 114 shows all possible combinations and corresponding payouts in substantially real-time as the odds change. The list shows that a winning $1 exacta wager on #2 (Woods—$1^{st}$) and #1 (Mickelson—$2^{nd}$) pays $8, and a winning $1 quinella wager on #2 (Woods) and #1 (Mickelson) pays $5. A winning $1 trifecta wager on #2 (Woods—$1^{st}$), #1 (Mickelson—$2^{nd}$) and #5 (Garcia—$3^{rd}$) pays $78. With the pari-mutuel system disclosed herein, bettors have the opportunity to receive large payouts on small wagers. Moreover, the final odds are established by the wagers of the bettors. It is further envisioned that the system may aggregate statewide, countrywide, and/or online wagers to form large pools from which to develop the odds and provide the referenced payouts. While the above scenario, with reference to FIGS. 3 through 5, refers to golf, this scenario is merely exemplary and the system and method described can be extended for use in any pari-mutuel wager, and particularly those events which comprise multiple actions.

While the above scenario involving a golf tournament referenced wagers on the winner of the tournament, the pari-mutuel wagering system of the present invention can further be employed to permit wagering for other actions within the multi-action event. As already stated above, wagers can further be made on predicting the leader of the tournament after each of the four rounds. Additional wagers, known as propositional wagers, can be made for each of the four days, for one or more of the four days, or for the entire four day tournament. Examples of propositional wagers for a golf tournament include predicting the golfer with the longest drive, most drives on the fairway over 300 yards, most drives on the fairway over 325 yards, most drives on the fairway over 350 yards, shortest drive, most fairways, least fairways, most greens in regulation, fewest greens in regulation, must putts made, least putts made, most bunkers landed in, least bunkers landed in, most chip-ins, most whole-outs, most eagles, most birdies, most bogies, most double bogies, most pars, most holes in one, on the green closest to the pin on a par 3, the lowest 9 score, the highest 9 score, first time Tour winners and the like. The pari-mutuel wagering system of the present invention also enables wagering over successive weeks and may include wagers for the entire golf season, i.e. the PGA Tour. The above referenced wagers can be extended to the golf season, with additional propositional wagers including most wins, most major tournament wins, win by biggest margin, rookie of the year, comeback player of the year, player of the year, Hogan award recipient, predict winners of each of four (Grand Slam) or five (Super Grand Slam) of the six recognized world tours (PGA Tour, European Tour, Asian Tour, PGA Tour of Australia, Japan Golf Tour, and the Sunshine Tour), longest run to make the cut, and the like. Additionally, suitable over-under wagers are established with regard to each of the above scenarios.

Figure 6:
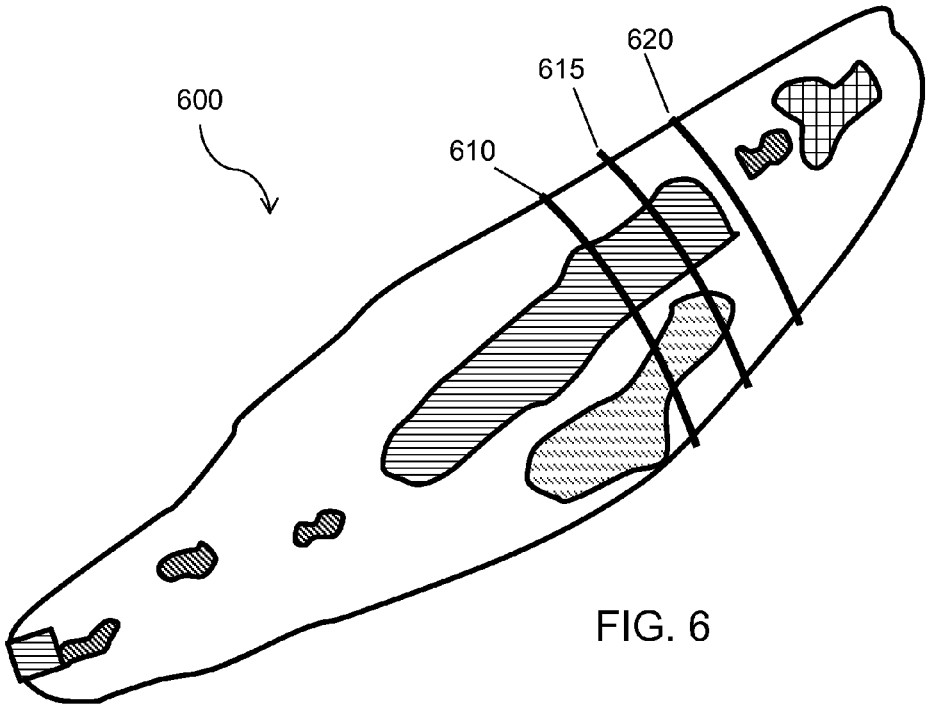
FIG. 6 is a schematic representation of a golf course hole including telestrator lines imposed thereover.
Figure 7:
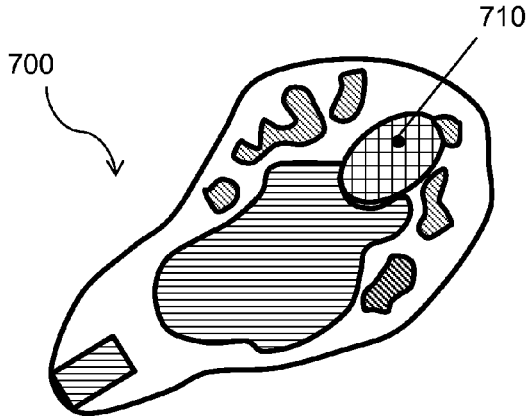
FIG. 7 is a schematic representation of another golf course hole including telestrator highlighting of the hole.

Adverting now to FIGS. 6 and 7, a further embodiment of the pari-mutuel wagering system of the present invention employs a telestrator or other image marker to overlay a highlight of wager-specific information on a video image. To continue the example of a golf tournament, examples of wager-specific information displayed by the telestrator are the 300 yard (reference numeral 610) and/or 325 yard (reference numeral 615) and/or 350 yard line (reference numeral 620) on the fairways of a par five hole 600 so that bettors can watch in real-time which golfers drive their tee beyond these markers (see FIG. 6). Thus, excitement is generated as the bettors watch in real-time the results of their predictions. Similarly, as shown in FIG. 7, for a par three hole 700, the telestrator highlights the hole 710 so that bettors can see which drive ends up closest to the pin, and whether there is a hole in one. Additionally, in further embodiments, the telestrator is linked with a GPS coordinate system such that, depending on the results for a particular hole, (e.g. the longest drive or shortest drive for a par five, or the closet drive to the pin for a par three), golfer results are statically overlaid on the video image with the length of the drive or distance to the hole displayed. Thus, bettors can watch as golfers tee off to see each golfer's shot and watch in real-time to determine whether their predictions were correct and whether they will collect on their wager. The use of the telestrator, with or without the added GPS capability, thus provides added excitement to the bettor by providing real-time, immediate action rather than merely waiting until the conclusion of the tournament to determine if a prediction of the winners was correct. This added excitement leads to increased wagering and larger betting pools, thereby generating larger payouts to winners as well as larger administrative fees received by the sports book.

Another example of a multi-action event is a NASCAR stock car race. A NASCAR races are generally held on Sundays. However, before the official race, drivers and teams undergo qualifying to determine which drivers and cars are entered into the field, as well as determining the order of the cars to start the race, with the fastest car earning the pole position. Qualifying is typically conducted on Fridays. Drivers and teams then use Saturday to test the car's performance and make any adjustments they feel are necessary prior to Sunday's race. These Saturday sessions are commonly referred to as "Happy Hour."

Presently, wagering on NASCAR typically involves predicting the winner and/or top two or three finishers of the official race, similar to horse racing. The present invention extends pari-mutuel wagering beyond merely picking the winner of the race. The pari-mutuel wagering system of the present invention promotes propositional wagering on each of the three days of a typical NASCAR weekend. Thus, during Friday qualifications, bettors can wager on predicting whether a driver will crash during qualification, break a course record during qualification, fail to finish qualifying, which driver wins the pole position, whether a driver will be within or without the top ten finishers in qualifying, or whether a driver will be within a specific range of qualifiers (i.e. positions 1-5; 6-10; 11-15, etc.). Similar wagers can be extended to the Happy Hour sessions, such as which driver will crash during happy hour, which driver had the fastest lap, which driver had the slowest car. Race day wagers can also be extended to include wagers on whether there will be a crash on the first lap, a crash within the first 5 laps or ten laps, which lap the first yellow or first red flags will come out, how many drivers are involved in the first crash, whether two specific drivers crash into each other, how many drivers are in the largest crash, whether the entire race will run without a crash, most laps led, most laps led and win, most laps led and not win, how many pits a driver makes, the number of tires a driver changes, who changes the most or least number of tires, whether a driver will crash and still win, which driver was in the most crashes and still finishes the race, first time winners in the series (e.g. Sprint Cup Series, Nationwide Series, Camping World Trucks Series), and the like. Although described as individual drivers, the above wagers can also be made based upon teams or stables of cars, e.g. Hendrick Motorsports, Joe Gibbs Racing or Richard Childress Racing, etc. Furthermore, although described with reference to NASCAR, those skilled in the art understand that the pari-mutuel wagering system described above can be extended beyond NASCAR to include other automobile racing (e.g. Formula 1, IndyCar, World Rally Championships, LeMans) or motorcycle/motocross events. Additionally, suitable over-under wagers are established with regard to each of the above scenarios.

Figure 8:
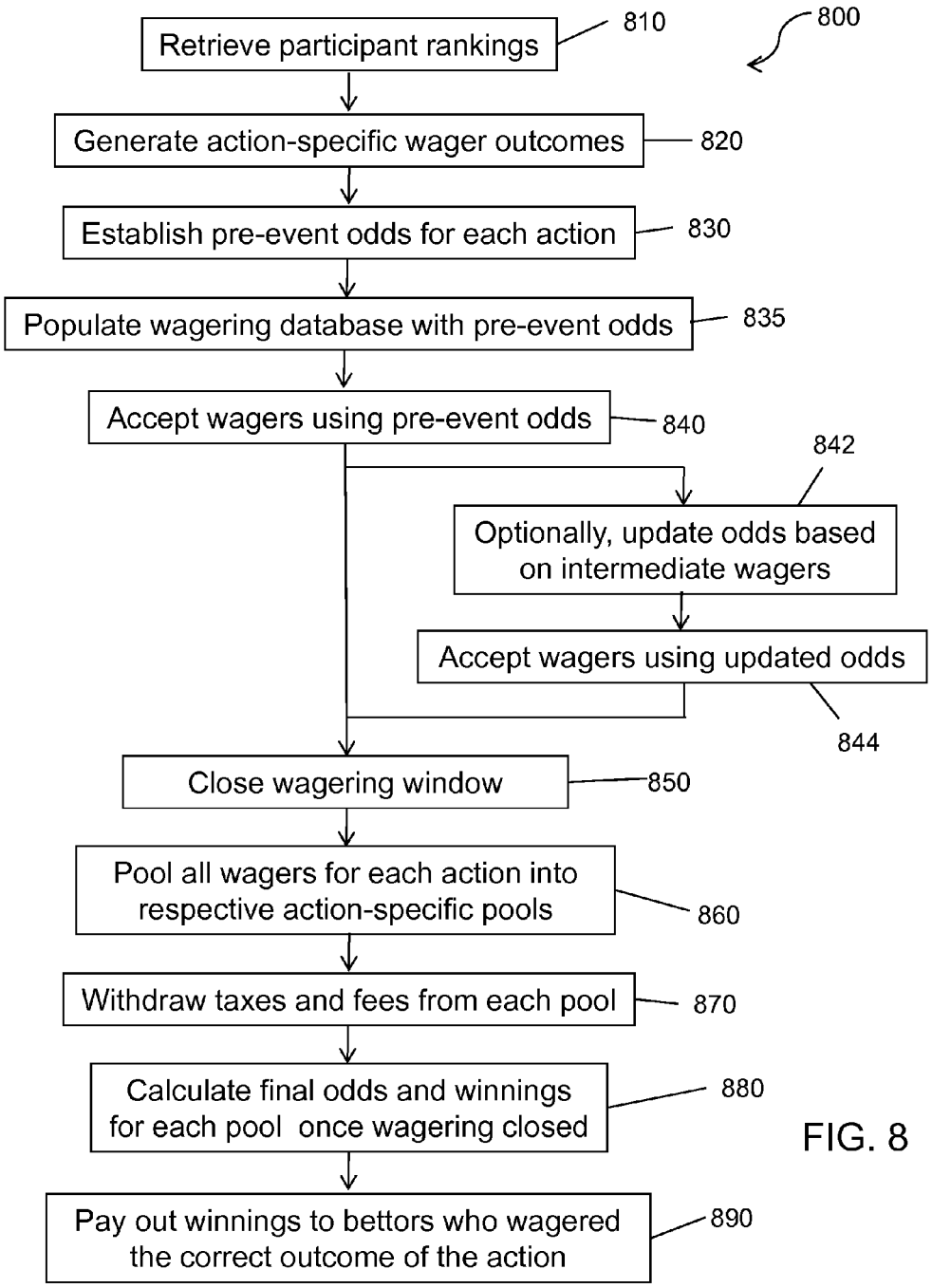
FIG. 8 is a flow diagram for one method of utilizing a pari-mutuel wagering system of the present invention.

Adverting now to FIG. 8, a flow diagram for a method of utilizing a pari-mutuel wagering system of the present invention is generally indicated by reference numeral 800. In step 810, software resident on the wagering server 110 retrieves and updates participant rankings within sports book database 111. For instance, golf tournaments and NASCAR races generally conclude on Sundays. The software contains code which directs the server to access the official rankings of event participants (i.e. the Official World Golf Ranking listed on the internet website: http://www.officialworldgolfranking.com/rankings/default.sps; or the NASCAR Sprint Cup rankings found at: http://www.nascar.com/races/cup/2012/data/standings.html). The software also generates a number of action-specific wager outcomes based upon the event and the retrieved rankings (step 820). Typically, these action-specific outcomes are duplicative from event-to-event within the same Tour or Series (for instance, all PGA Tour events or NASCAR races will have the same actions on which bettors can wager, as described above). An authorized line maker then accesses sports book database 111 via the sports book application 113, to view the updated rankings. The line maker then establishes pre-event odds for the immediately upcoming event (i.e. golf tournament or NASCAR race) after analyzing all appropriate data and lists those odds in order with regard to the official rankings (step 830). As shown in Step 835, once the pre-event odds are established, the sports book then inputs this data into the wagering database 112. Bettors then access the wagering database 112 either through a bettor terminal running wagering application 114, or through a sports book employee at the brick-and-mortar facility, or online via an internet-capable device running wagering application 114. Bettors can then place wagers on the action-specific outcomes for which pre-event odds have been determined (step 840). In one embodiment of the present invention, odds are continually updated in real-time reflecting the change in odds due to bettor wagers as described above (step 842). Bettors continue to wager based upon these updated odds (step 844). Step 850 closes the wagering window meaning that no new wagers will be accepted for the closed action. Wagering typically ends at the start of the particular action. For instance, wagers predicting the winner of a tournament or race closes at the start of the event. Similarly, wagers regarding specific days of a golf tournament close prior to the start of golf on the respective day. Once a wagering window is closed, all wagers made regarding that action are pooled into an action-specific pool (step 860). The house deducts all administrative fees and taxes for the pool (step 870) and calculates the final odds and the winnings for that action (step 880). Finally, in step 890, once the action has been completed (i.e. completion of day one of a golf tournament or qualifying during a NASCAR event), payouts are made to bettors who correctly predicted the outcome of the action (i.e. the leader after round one or the driver in the pole position).

Depending upon the action, outcomes from one day of action are used to generate new action-specific outcomes (indicated by arrow 395). Thus, wagers regarding the second round of a golf tournament are established based upon the results of the first round. The line makers generate pre-event odds for the second round within the sports book database 111 which are then uploaded and stored to wagering server 110. Bettors then access the server through the wagering database and wagering application and commence wagering on second round actions. Thus, the pari-mutuel wagering system and method of the present invention extends wagering from merely predicting winners of an event and promotes wagering throughout the course of the event while also promoting wagering on not just predicting winners, but also predicting a number of additional actions. As such, wagering action is no longer simply placing a futures bet and waiting three or four days for an outcome. Wagering action is now immediate and accessible on a day-by-day or action-by-action basis. This immediate action will stimulate wagering leading to larger pools and payouts, as well as larger fees for the house and taxes for regulating agencies.

Although the present invention has been described in considerable detail with reference to certain aspects thereof, other versions are possible. Therefore, the spirit and scope of the appended claims should not be limited to the description of the aspects contained herein.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A method for conducting pari-mutuel wagering on a multi-action event having a plurality of individual actions, the method comprising the steps of:

a. providing at least one wagering computing system for ranking of participants in said event;

b. establishing preliminary odds of winning a wager, based in part upon said rankings, for each of said plurality of individual actions within said multi-action event;

c. accepting wagers for each of said plurality of individual actions;

d. pooling respective wagers for each of said plurality of individual actions into a respective action-specific pool;

e. calculating, using said wagering computing system, final odds of winning each of said plurality of individual actions using said action-specific pool; and f. paying winnings as determined by said final odds to one or more bettors who wagered a correct outcome for each of said plurality of individual actions.

2. The method of claim 1 wherein said multi-action event is selected from the list consisting of: automobile races, bicycle races, golf, tennis, track-and-field competition, Olympic Games, and motorcycles races.

3. The method of claim 1 wherein said multi-action event is golf.

4. The method of claim 3 wherein said rankings are tabulated by Official World Golf Ranking.

5. The method of claim 3 wherein said plurality of individual actions comprises a first round leader; a second round leader; participants who qualify for later rounds; participants who fail to qualify for later rounds; a third round leader; a tournament winner.

6. The method of claim 1 wherein said multi-action event is a bicycle race.

7. The method of claim 6 wherein said rankings are tabulated by Union Cycliste Internationale.

8. The method of claim 1 wherein said multi-action event is an automobile race wherein said automobiles complete at least one lap of a course.

9. The method of claim 8 wherein said automobile race is a NASCAR race.

10. The method of claim 9 wherein said rankings are tabulated by NASCAR.

11. The method of claim 9 wherein said plurality of individual actions comprises a pole position winner; fastest car in Happy Hour; winner of official NASCAR race; driver to lead the most laps; driver to lead the most laps and win; driver to lead the most laps and not win.

12. The method of claim 1 further comprising the steps of:

g. simulcasting video of said event; and h. highlighting wager-specific information on said video.

13. A method for conducting pari-mutuel wagering on a multi-action event having a plurality of individual actions, the method comprising:

a. providing at least one wagering computing system for ranking of participants in said event;

b. establishing preliminary odds of winning a wager, based in part upon said rankings, for each of said plurality of individual actions within said multi-action event;

c. accepting wagers for each of said plurality of individual actions;

d. pooling respective wagers for each of said plurality of individual actions into a respective action-specific pool;

e. calculating, using said wagering computing system, final odds of winning each of said plurality of individual actions using said action-specific pool;

f. paying winnings as determined by said final odds to one or more bettors who wagered a correct outcome for each of said plurality of individual actions;

g. simulcasting video of said event; and h. highlighting wager-specific information on said video, wherein said highlighting is by a telestrator.

14. A method for conducting pari-mutuel wagering on a multi-day event having a plurality of individual action days, the method comprising the steps of:

a. providing at least one wagering computing system for initially ranking participants in the event;

b. establishing preliminary odds of winning a wager, based in part upon said initial rankings, for each of the plurality of individual action days within the multi-day event;

c. accepting initial wagers for each of the plurality of individual action days based upon said initial rankings;

d. pooling respective initial wagers for each of the plurality of individual action days into respective initial action day specific pools;

e. calculating, using said wagering computing system, respective final odds of winning each of the plurality of individual action days using each respective initial action day specific pool;

g. establishing updated odds of winning a wager, based in part upon each participant's finishing position after a previous day of the multi-day event, for each remaining individual action day within the multi-day event;

h. accepting updated wagers for each remaining individual action day based upon said updated odds;

i. pooling respective updated wagers for each remaining individual action day into respective updated action day specific pools;

j. calculating, using said wagering computing system, respective updated final odds of winning each of the remaining action days using each respective updated action day specific pool;

k. paying winnings from each respective initial action day specific pool and each respective updated action day specific pool as determined by each respective final odds and updated final odds to one or more bettors who wagered a correct outcome.

* * * * *